US006460199B1

(12) United States Patent
Sands

(10) Patent No.: US 6,460,199 B1
(45) Date of Patent: Oct. 8, 2002

(54) NO-SLIP, NO-SPILL, NO-HANDS URINAL

(76) Inventor: Patricia Carol Sands, 6144 N. 12th Rd., Arlington, VA (US) 22205

( * ) Notice: Subject to any disclaimer, the term of this patent is extended or adjusted under 35 U.S.C. 154(b) by 0 days.

(21) Appl. No.: 09/962,077

(22) Filed: Sep. 26, 2001

Related U.S. Application Data

(60) Provisional application No. 60/236,817, filed on Oct. 2, 2000.

(51) Int. Cl.[7] ..... A47K 11/02

(52) U.S. Cl. ..... 4/144.3; 4/144.1; 604/329; D24/123

(58) Field of Search ..... 4/114.1, 144.1–144.4; 604/329; D24/123

(56) References Cited

U.S. PATENT DOCUMENTS 661,403 A * 11/1900 Hogan ..... 4/144.3
2,594,339 A * 4/1952 Nugent ..... 4/144.1
4,309,779 A * 1/1982 Knight ..... 4/144.1

* cited by examiner

*Primary Examiner*—David J. Walczak
*Assistant Examiner*—Tuan Nguyen
(74) *Attorney, Agent, or Firm*—Michael J. Foycik, Jr.

(57) ABSTRACT

A no-slip, no-spill, no-hands urinal is used to provide more freedom and a more hygienic environment for a person confined to a wheelchair or bed. The urinal includes a soft, clear plastic body with rounded edges, and having a shape permitting it to be fit close to the body of the user and under the thighs of the user. The shape of the urinal is flattened toward the front. The urinal has a concave front section, conforming with the male anatomy, allowing a closer and more comfortable fit for male users. The urinal includes a no-spill feature, provided by a platform portion inside the opening formed in the urinal body, and this platform additionally serves to keep the male member above the opening in the receptacle portion of the urinal and to keep the male member out of the urine in the receptacle portion. The platform portion enables the urinal to retain liquid without spilling even when it is tilted forward. The urinal includes a pouring spout formed along the forward and upper portion of the opening in the receptacle area. The emptying or pouring is performed by rotating the urinal backwards, front end over the rear end thereof.

6 Claims, 5 Drawing Sheets

NO-SLIP, NO-SPILL, NO-HANDS URINAL

This application claims the benefit of U.S. provisional application No. 60/236,817, filed Oct. 2, 2000

FIELD OF THE INVENTION

The present invention relates to a no-slip, no-spill, no-hands urinal, which is especially for use by a person confined to a wheelchair or bed with an incontinence problem.

BACKGROUND OF THE INVENTION

Portable urinals are known in the art. Such urinals can take the form of simple bowls or containers, or may have spouts or the like.

It is, however, a problem in the art to provide a urinal which provides more freedom and a more hygienic environment for a person confined to a wheelchair or bed.

It is a further problem in the art to provide a urinal which stays in place without being held, and is resistant to urine spillage.

It is another problem in the art to provide a urinal which can be comfortably used for hours at a time.

SUMMARY OF THE INVENTION

From the foregoing, it is seen that it is a problem in the art to provide a device meeting the above requirements. According to the present invention, a device and process are provided which meets the aforementioned requirements and needs in the prior art. Specifically, the device according to the present invention provides a no-slip, no-spill, no-hands urinal.

More particularly, the invention relates to a no-slip, no-spill, no-hands urinal which provides more freedom and a more hygienic environment for a person confined to a wheelchair or bed. Further, the no-slip, no-spill, no-hands urinal of the present invention is shaped such that it stays in place without being held, and is resistant to urine spillage. The no-slip, no-spill, no-hands urinal of the present invention is shaped such that it can be comfortably used for hours at a time.

The no-slip, no-spill, no-hands urinal of the present invention includes a soft, clear plastic body with rounded edges, and having a shape permitting it to be fit close to the body of the user and under the thighs of the user. It thereby uses the pressure of the thighs of the user to hold it in place. The shape of the no-slip, no-spill, no-hands urinal of the present invention is flattened toward the front.

The no-slip, no-spill, no-hands urinal has a concave front section, conforming with the male anatomy, allowing a closer and more comfortable fit for male users. The no-slip, nospill, no-hands urinal of the present invention also includes a no-spill feature, provided by provision of a platform portion inside the opening formed in the urinal body. The platform additionally serves to keep the male member above the opening in the receptacle portion of the urinal, and to keep the male member out of the urine in the receptacle portion. The platform enables the urinal to retain liquid without spilling even when it is tilted forward. Thus, the urine cannot be spilled backward into the body of the user unless it is tilted to an extreme angle or filled to over its capacity.

The no-slip, no-spill, no-hands urinal includes a pouring spout formed along the forward and upper portion of the opening in the receptacle area. The emptying or pouring is performed by rotating the urinal backwards, front end over the rear end thereof.

The no-slip, no-spill, no-hands urinal of the present invention is formed of clear plastic which is marked in liquid measure intervals such as milliliters (ml.) for easy measuring, for use in keeping urine output records.

The no-slip, no-spill, no-hands urinal of the present invention further includes a handle that can hook onto a wheelchair when not in use. The urinal has been provided with a wide opening so that it can be disinfected with ease.

In an alternative embodiment, the urinal is as described above, but omitting the no-spill feature.

Other objects and advantages of the present invention will be more readily apparent from the following detailed description when read in conjunction with the accompanying drawings.

DETAILED DESCRIPTION OF THE INVENTION

Figure 1:
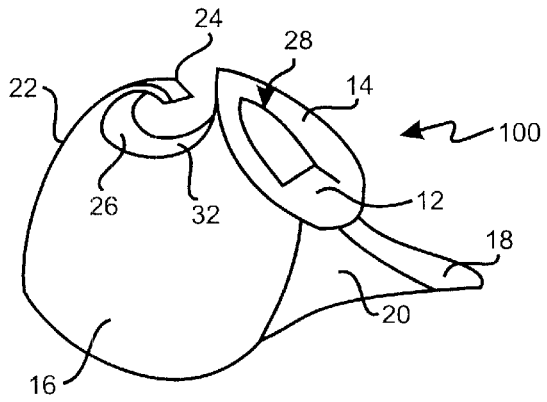
FIG. 1 is a perspective view from the front and left of a no-slip, no-spill, no-hands urinal according to the present invention.

FIG. 1 is a perspective view from the front and left of a no-slip, no-spill, no-hands urinal 100. The urinal 100 has a concave front surface 20, a left side portion 16, a right side portion 18, a lip 14, an aperture 28, and a platform 12. The aperture 28 opens into the hollow interior receptacle portion of the urinal 100.

As seen in FIG. 1, the urinal 100 includes a curved handle portion 24, and a rear spout portion 26. A spout wall portion 32 forms the leading edge for pouring when emptying the urinal 100 by inversion thereof end-over-end. The urinal 100 has a rear surface 22, not shown in FIG. 1.

The urinal 100 is a no-slip, no-spill, no-hands urinal which provides more freedom and a more hygienic environment for a person confined to a wheelchair or bed. Further, the noslip, no-spill, no-hands urinal 100 is shaped such that it stays in place without being held, and is resistant to urine spillage. The no-slip, no-spill, no-hands urinal 100 is shaped such that it can be comfortably used for hours at a time.

The no-slip, no-spill, no-hands urinal 100 includes a soft, clear plastic body with rounded edges, and having a shape permitting it to be fit close to the body of the user and under the thighs of the user. It thereby uses the pressure of the thighs of the user to hold it in place, that is, the pressure of the thighs on the left side portion 16 and the right side portion 18. The shape of the no-slip, no-spill, no-hands urinal 100 is flattened in a direction toward the front thereof.

The no-slip, no-spill, no-hands urinal 100 has a concave front section 20, conforming with the male anatomy, allowing a closer and more comfortable fit for male users. This concavity is especially evident in FIGS. 3 and 4, and provides room for the comfortable fit of the testicles of a male user when the male member rests on the platform 12.

The no-slip, no-spill, no-hands urinal 100 also includes a no-spill feature, provided by provision of the platform 12 at the bottom of the lip 14 and extending inside the opening 28 formed in the urinal body. The platform 12 additionally serves to keep the male member above the opening in the receptacle portion of the urinal, and to keep the male member out of the urine in the receptacle portion. The platform 12 enables the urinal 100 to retain liquid without spilling even when it is tilted forward. Thus, the urine cannot be spilled backward into the body of the user unless the urinal 100 is tilted to an extreme angle or filled to over its capacity.

The no-slip, no-spill, no-hands urinal 100 includes a pouring spout portion formed along the forward and upper portion of the opening 28 in the receptacle area. The emptying or pouring is performed by rotating the urinal 100 backwards, front end over the rear end thereof.

The urinal 100 is preferably formed of clear plastic which is marked in liquid measure intervals such as milliliters (ml.) or ounces, for example, to permit easy measuring, and for use in keeping urine output records.

The urinal 100 further includes the handle 24 that can hook onto a wheelchair when not in use. The urinal 100 has been provided with a relatively wide opening 28 so that it can be disinfected with ease.

The benefits of the urinal 100 of the present invention include providing a safe and sanitary alternative to use of catheters which might precipitate an internal urinary tract infection. Another benefit is the decrease in the possibility of bedsores from having the urine spill on the body of the user. Further, there is the benefit of freeing the user from having to hold the urinal in place manually for extended periods of time, and of freeing a caregiver or caretaker from having to hold the urinal in place manually.

The urinal 100 can advantageously be used in bed, and in seats or chairs including wheelchairs. The urinal 100 is reusable and sanitary, and can be used in homes, nursing homes, and hospitals.

Figure 2:
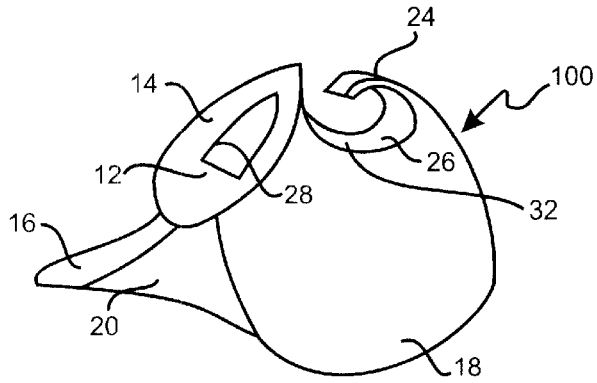
FIG. 2 is a perspective view from the front and right of the no-slip, no-spill, no-hands urinal of FIG. 1, according to the present invention.

FIG. 2 is a perspective view from the front and right of the no-slip, no-spill, no-hands urinal 100 of FIG. 1. The numbered elements of urinal 100 in this view are the same as that of FIG. 1.

Figure 3:
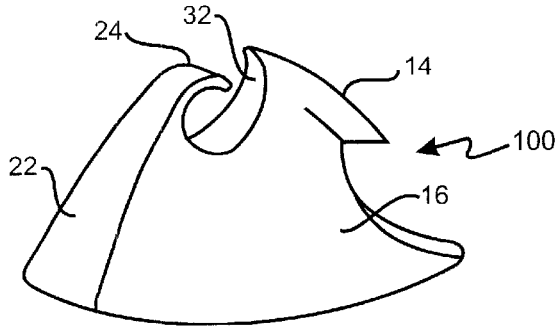
FIG. 3 is a perspective view from the left and rear of the no-slip, no-spill, no-hands urinal of FIG. 1.

FIG. 3 is a perspective view from the left and rear of the no-slip, no-spill, no-hands urinal 100 of FIG. 1. The numbered elements of urinal 100 in this view are the same as that of FIG. 1.

Figure 4:
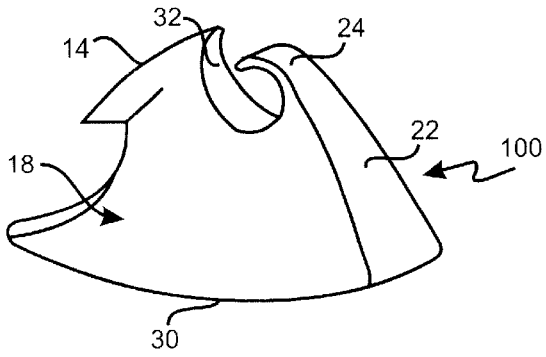
FIG. 4 is a perspective view from the right and rear of the no-slip, no-spill, no-hands urinal of FIG. 1, according to the present invention.

FIG. 4 is a perspective view from the right and rear of the no-slip, no-spill, no-hands urinal 100 of FIG. 1. The numbered elements of urinal 100 in this view are the same as that of FIG. 1.

Figure 5:
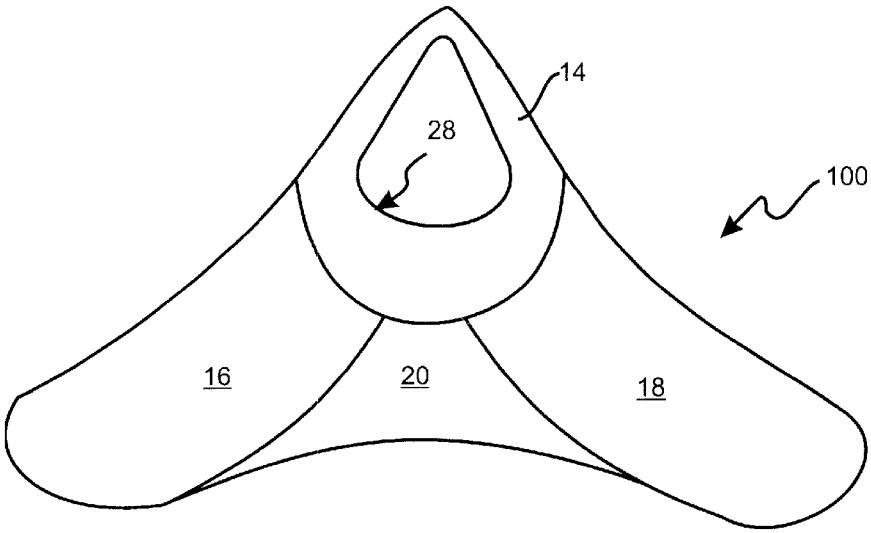
FIG. 5 is a front elevational view of the no-slip, no-spill, no-hands urinal of FIG. 1, according to the present invention.

FIG. 5 is a front elevational view of the no-slip, no-spill, no-hands urinal 100 of FIG. 1. The numbered elements of urinal 100 in this view are the same as that of FIG. 1. In this view, the wing-like shapes of the left side portions 16 and 18 are clearly shown. These shapes, of portions 16 and 18, enable them to fit under the thighs of a user, so that the pressure of the thighs can retain the urinal 100 in position for use for extended periods of time. Typical dimensions of the lip 14 at its widest portion in FIG. 5 are 3 and ¼ inches, and the lowest portion of the lip 14 is about 2 and ¾ inches from the bottom 30 (shown in FIG. 8) of the urinal 100. The overall height of the urinal 100 in FIG. 5 is about 6 inches. The overall width of the urinal 100 in FIG. 5 is about 11 inches.

Figure 6:
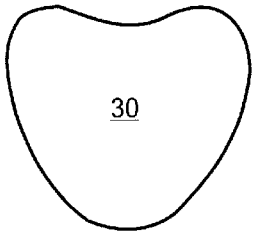
FIG. 6 is a bottom elevational view of the no-slip, no-spill, no-hands urinal of FIG. 1, according to the present invention.

FIG. 6 is a bottom elevational view of the no-slip, no-spill, no-hands urinal 100 of FIG. 1, showing its bottom surface 30. Typical dimensions of the bottom surface 30 are 11 inches in width and 11 and ¼ inches in height.

Figure 7:
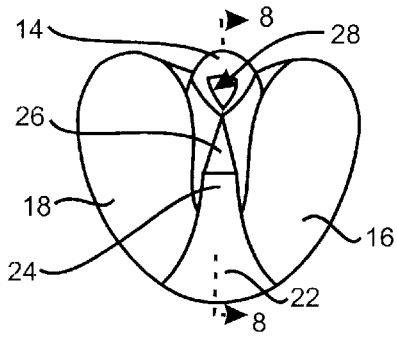
FIG. 7 is a top elevational view of the no-slip, no-spill, no-hands urinal of FIG. 1, according to the present invention.

FIG. 7 is a top elevational view of the no-slip, no-spill, no-hands urinal 100.

Figure 8:
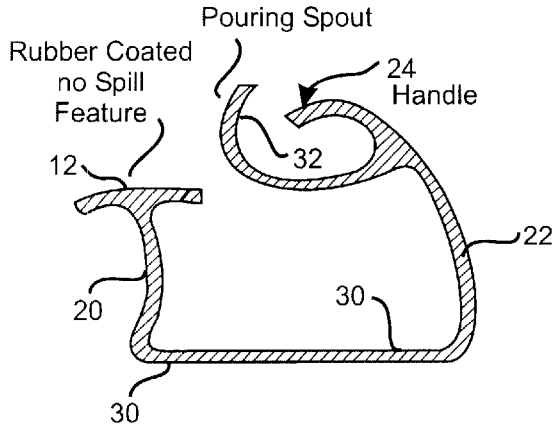
FIG. 8 is a longitudinal sectional view taken along line 8—8 of FIG. 7.

FIG. 8 is a longitudinal sectional view taken along line 8—8 of FIG. 7. In this view, the platform 12, which forms part of the no-spill feature of the present invention, is clearly seen extending into the interior portion of the urinal 100. The length of the platform 12, measured from left to right in FIG. 8, is about 2 and ½ inches. The interior dimension of the urinal 100 in FIG. 8 between the walls 20 and 22 is about 2 and ¼ inches in height, 6 inches in width, and 5 inches in depth; these dimensions are merely exemplary, however, and any variations therein are contemplated as being within the scope of the present invention. For example, different dimensions may be made to take into account sizes for adults, children, males and females. Further, various materials can be used to form the urinal 100, including plastic, rubber, metal, and composite materials.

Figure 9:
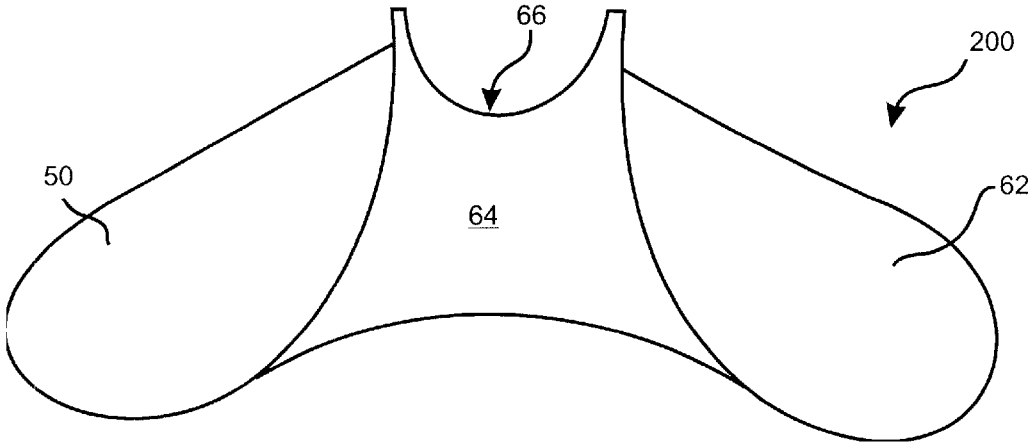
FIG. 9 is a front elevational view of an alternative embodiment of the no-slip, no-spill, no-hands urinal according to the present invention.

FIG. 9 is a front elevational view of an alternative embodiment of a no-slip, no-spill, no-hands urinal 200. The urinal 200 has a left portion 50, a right portion 62, a concave front portion 64, and curved front lip 66. The functions and overall design of the urinal 200, other than the curved front lip 66, is substantially similar to that of urinal 100 of FIGS. 1–8.

Figure 10:
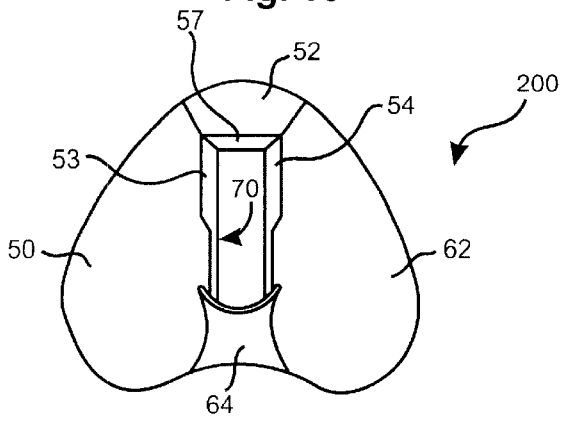
FIG. 10 is a top elevational view of the alternative embodiment of the no-slip, no-spill, no-hands urinal according to the present invention.

FIG. 10 is a top elevational view of the alternative embodiment of the no-slip, no-spill, no-hands urinal 200. In this view, an aperture 70 is surrounded by a lip formed by portions 53, 54, and 57. A rear wall portion 52 is also visible in FIG. 10.

Figure 11:
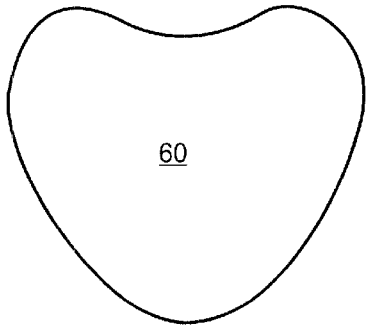
FIG. 11 is a bottom elevational view of the alternative embodiment of the no-slip, no-spill, no-hands urinal according to the present invention.

FIG. 11 is a bottom elevational view of the alternative embodiment of the no-slip, nospill, no-hands urinal 200. The bottom surface 60 is shown in this view, and preferably has dimensions which are 11 inches in width and 11 and ¼ inches in height.

Figure 12:
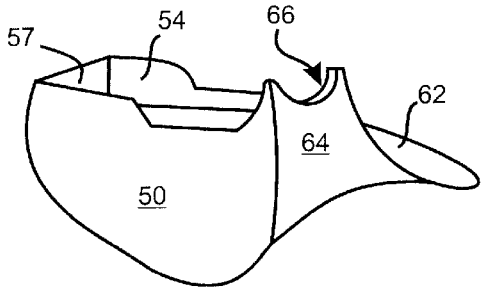
FIG. 12 is a perspective view from the front and left of the alternative embodiment of the no-slip, no-spill, no-hands urinal according to the present invention.

FIG. 12 is a perspective view from the front and left of the alternative embodiment of the no-slip, no-spill, no-hands urinal 200.

Figure 13:
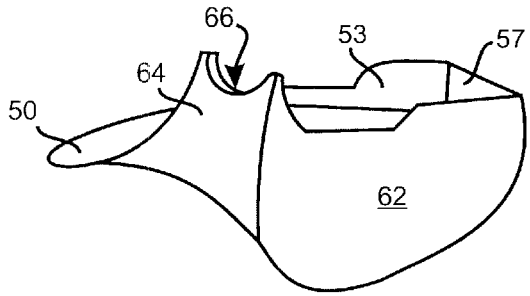
FIG. 13 is a perspective view from the front and right of the alternative embodiment of the no-slip, no-spill, no-hands urinal according to the present invention.

FIG. 13 is a perspective view from the front and right of the alternative embodiment of the no-slip, no-spill, no-hands urinal 200.

Figure 14:
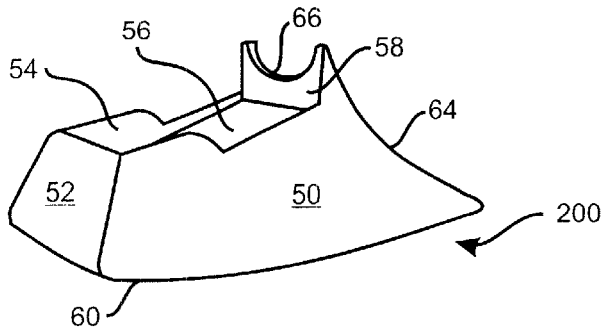
FIG. 14 is a perspective view from the left and rear of the alternative embodiment of the no-slip, no-spill, no-hands urinal according to the present invention.

FIG. 14 is a perspective view from the left and rear of the alternative embodiment of the no-slip, no-spill, no-hands urinal 200. The interior portion 56 of the urinal 200 is seen beneath the curved front lip 66 in this view.

Figure 15:
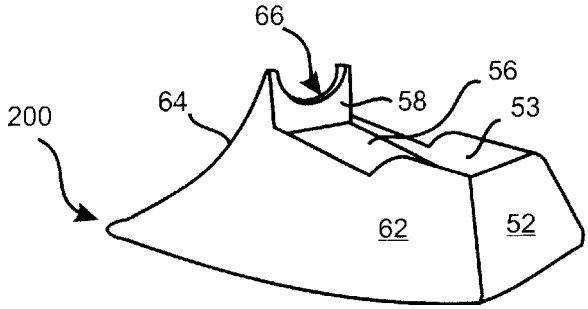
FIG. 15 is a perspective view from the right and rear of the alternative embodiment of the no-slip, no-spill, no-hands urinal according to the present invention.

FIG. 15 is a perspective view from the right and rear of the alternative embodiment of the no-slip, no-spill, no-hands urinal 200.

The overall dimensions, composition, features and advantages of the embodiment shown in FIGS. 9–15 are substantially the same as for the embodiment of FIGS. 1–8. Similarly, all variations in dimensions are contemplated as being within the scope of the invention thereof.

The invention being thus described, it will be evident that the same may be varied in many ways. Such variations are not to be regarded as a departure from the spirit and scope of the invention and all such modifications are intended to be included within the scope of the claims.

What is claimed is:

1. A urinal having a hollow interior forming a urine receptacle, comprising:

a body having a front and a rear;

a left portion of said body tapering downwardly and tapering toward the front of the body;

a right portion of said body tapering downwardly and tapering toward the front of the body;

a concave front portion of said body disposed between said left portion and said right portion;

a lip portion above said left portion and said right portion, said lip surrounding an aperture in said body; and a platform disposed at a bottom side of said lip, said platform extending into said aperture; whereby said platform serves as a resting surface for an appendage of a human body, and to prevent spillage when said body is tilted toward the user.

2. A urinal according to claim 1, further comprising a pouring spout portion formed along a forward and upper portion of said aperture, such that emptying or pouring of liquid within said body is performed by rotating said body in a backwards direction, front end over rear end.

3. A urinal according to claim 1, further comprising a handle that can hook onto a wheelchair or a hook.

4. A urinal according to claim 1, wherein said aperture has a relatively wide opening, so that it can be disinfected with ease.

5. A urinal according to claim 1, wherein said body is composed of clear plastic, such that liquid inside said body is visible.

6. A urinal according to claim 1, wherein said body is marked in liquid measure intervals for use in keeping urine output records.

* * * * *